United States Patent [19]

Esser

[11] Patent Number: 4,606,203

[45] Date of Patent: Aug. 19, 1986

[54] LATCH AND DEADBOLT LOCK SET

[75] Inventor: Hans Esser, Keysborough, Australia

[73] Assignee: Ogden Industries Pty. Ltd., Huntingdale, Australia

[21] Appl. No.: 606,871

[22] Filed: May 1, 1984

[30] Foreign Application Priority Data

May 4, 1983 [AU] Australia ..... PF9174/83

[51] Int. Cl.[4] ..... E05B 59/00

[52] U.S. Cl. ..... 70/107; 70/462; 292/34; 292/39

[58] Field of Search ..... 70/107, 108, 109, 110, 70/111, 462; 292/34, 36, 37, 39, 40

[56] References Cited

U.S. PATENT DOCUMENTS

| | | | |
|---|---|---|---|
| 3,390,558 | 7/1968 | Tornoe | 70/107 |
| 3,631,695 | 1/1972 | Perlick | 70/462 |
| 3,672,714 | 6/1972 | Schultz | 70/107 |
| 3,808,849 | 5/1974 | Alexander | 70/107 |
| 4,011,741 | 3/1977 | Nolin | 70/107 |

*Primary Examiner*—Robert L. Wolfe

*Attorney, Agent, or Firm*—Berman, Aisenberg & Platt

[57] ABSTRACT

A lock set including a latchbolt, a deadbolt and control mechanism for both bolts. Each bolt is operable through either an external or an internal (i.e., relative to an associated door) actuator and the two internal actuators are interconnected through drive means so that operation of one to cause retraction of its respective bolt also causes retraction of the other bolt. The drive means includes a lost motion connection so that the latchbolt can be retracted and extended at will while the deadbolt remains in the retracted position. Locking means is operative to hold the external actuator of the latchbolt against operation and the deadbolt actuators are connected to that locking means so as to deactivate the locking means as the deadbolt is retracted. Both deadbolt actuators may be also connected to the locking means so as to activate that locking means when the deadbolt is moved towards its operative position. Operating means may also be provided to enable activation and deactivation of the locking means independant of the deadbolt actuators.

21 Claims, 10 Drawing Figures

LATCH AND DEADBOLT LOCK SET

This invention relates to lock sets for doors and the like and which are of the kind having a latch bolt and deadbolt.

A difficulty with many lock sets of the foregoing kind is that exit operation requires the use of two hands. That difficulty has been overcome with some lock sets which allow single handed exit operation, but the available lock sets of that kind are not entirely satisfactory. The interconnection between the latch and deadbolt mechanisms is generally such that separate externally operable key operated locks are required for the latch and deadbolt respectively. Also, it is either not possible or very inconvenient to alter the hand of operation of such locks.

An object of the present invention is to provide an improved form of lock set of the foregoing kind. In particular, it is an object of the invention to provide such a lock set in which a single key operated lock is required. It is a further object of the invention to provide such a lock set which is convenient to change from one hand of operation to the other. Yet another object of the invention is to provide improved control mechanism for a lock set of the foregoing kind. Such control mechanism enables withdrawal of both the latchbolt and the deadbolt by operation of a single knob or handle, which in use will usually be located on the inside of the door.

A lock set according to the invention is arranged so that operation of the deadbolt causes operation of the latchbolt, but operation of the latchbolt independant of the deadbolt is possible. That is, the interconnection between those bolts remains intact for one style of operation only. The lock set preferably includes locking means which is operative to prevent outside operation of the latchbolt independant of operation of the deadbolt, and the control mechanism is such that the locking means is automatically activated and deactivated in response to appropriate operation of the deadbolt. Furthermore, clutch means may be provided in the control mechanism to allow movement of the deadbolt into an operative position while the locking means is activated. According to one aspect of the present invention, there is provided a lock set control mechanism including, a housing, latch bolt actuator means mounted on said housing and being movable relative thereto between latch bolt operative and inoperative positions, deadbolt actuator means mounted on said housing and being movable relative thereto between deadbolt operative and inoperative positions, a lock actuator mounted on said housing and being operable to cause operation of locking means which renders the latch bolt actuator means inoperable, said lock actuator is connected to the deadbolt actuator means to activate or deactivate said locking means according to whether said deadbolt actuator means is moved into its deadbolt operative or inoperative position respectively, and drive means interconnecting the two said bolt actuator means so that each is responsive to operation of the other such that movement of either said bolt actuator means towards its respective bolt inoperative position causes corresponding movement of the other said bolt actuator means.

According to another aspect of the invention there is provided a lock set including, a latch bolt and a deadbolt each of which is movable between operative and inoperative positions, control mechanism for both said bolts including separate actuator means for each said bolt and each being operable to move the respective said bolt between its operative and inoperative positions, locking means operative to render the latchbolt actuator means inoperable, a lock actuator connected to said locking means and to said deadbolt actuator means so as to activate or deactivate said locking means according to whether said deadbolt actuator means is operated to cause said deadbolt to move into its operative or inoperative position respectively, operating means connected to said lock actuator and being operative to render said locking means active and inactive independant of operation of said deadbolt actuator means, and clutch means forming part of the connection between said lock actuator and said locking means and being operative to allow said deadbolt actuator means to be operated to move the deadbolt towards its operative position when said locking means is active.

The essential features of the invention and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 1:
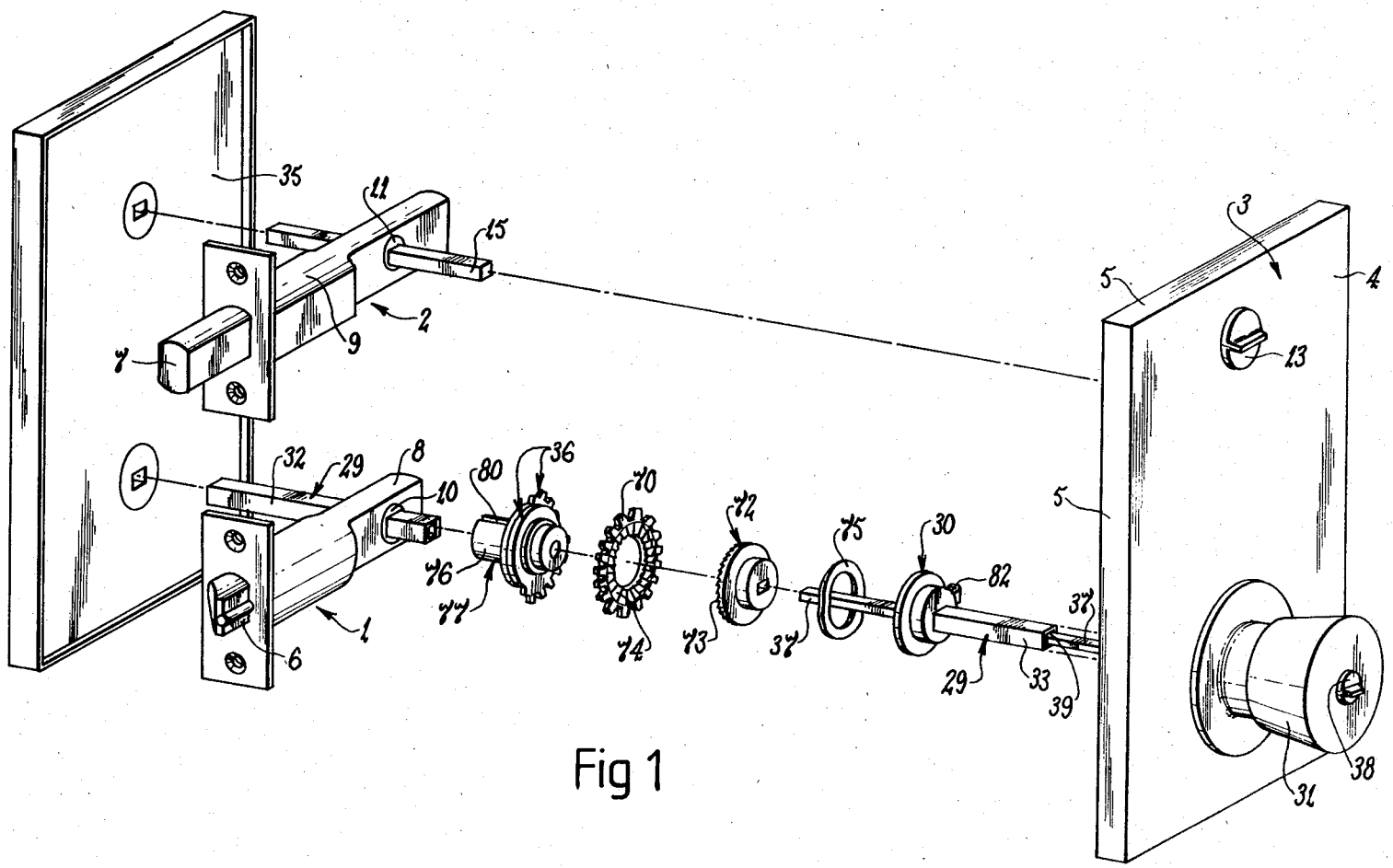
FIG. 1 is an exploded view of one form of lock set to which an embodiment of the invention has been applied.

In the particular form of lock set as shown in the accompanying drawings, the mechanism which controls operation of the latch and deadbolt assemblies 1 and 2 respectively is contained in a housing 3 which is securable to the inside surface of a door (not shown). According to the example shown, the housing 3 comprises a rectangular mounting plate 4 having a relatively shallow peripheral wall 5 on all sides. The peripheral wall 5 defines an open mouth of the housing 3 through which the mechanism is accessible and in use that open mouth is closed by the internal surface of an associated door against which the housing is secured, or by a cover plate (not shown).

Preferably, the latchbolt and deadbolt 6 and 7 respectively are each mounted in a respective tubular housing 8 and 9 which is insertable into an appropriate bore formed through the front edge of the door. Tubular bolt assemblies 1 and 2 of that kind are well known and do not require detailed explanation. It is perhaps sufficient to say that each assembly 1 and 2 includes a rotatable drive member 10 and 11 respectively which is cooperable with its respective bolt 6 and 7 to cause retraction of that bolt into the tubular housing 8 and 9 respectively to adopt an inoperative position. Spring means (not shown) is preferably contained within the latchbolt housing 8 to urge the latchbolt 6 into an operative position, and the deadbolt 7 may be similarly spring influenced if desired. It is also preferred that the latchbolt assembly 1 is of the deadlocking type, but that is not essential.

Figure 2:
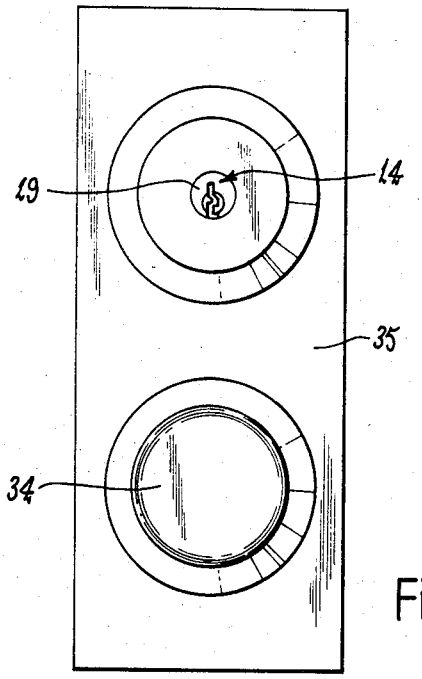
FIG. 2 is a front elevational view of external components of the lock set of FIG. 1.

The control mechanism includes deadbolt actuating means 12 (FIGS. 3 and 4) which is operable from either side of the associated door. In the form shown, that actuating means 12 is operable from the door inside by a turn knob 13 or handle (FIG. 1) and is operable from the door outside by a key operated tumbler lock 14 (FIG. 2). Linear movement of the deadbolt 7 is achieved through rotation of the rotatable drive member 11 and a drive spindle 15 connects the actuating means 12 to that drive member 11. In the example shown, the drive spindle 15 is of square section and fits within a corresondingly shaped bore 16 (FIG. 3) provided through the drive member 11 and a similar bore 17 provided in another member 18 (FIG. 3 and 4) rotatably mounted on the housing 3. In the arrangement shown, the member 18 is connected to the barrel 19 of the tumbler lock 14 so as to rotate in response to rotation of that barrel 19 and for convenience will be hereinafter called the lock drive member.

It will be apparent from the foregoing that rotation of the lock barrel 19 causes rotation of the lock drive member 18 which in turn causes rotation of the deadbolt drive spindle 15 so that the deadbolt 7 is moved linearly relative to its housing 9. Such linear movement can be initiated however, by rotation of the turn knob 13 through the influence of another part of the actuating means 12. In the form shown, that other part includes a further drive member 20 (FIGS. 3 and 4) rotatably mounted on the housing 3 and which is connected to the turn knob 13 to rotate in response to rotation of that knob 13. That further drive member 20 will be hereinafter called the turn knob drive member and is connected to the lock drive member 18 through lost motion means.

Figure 5:
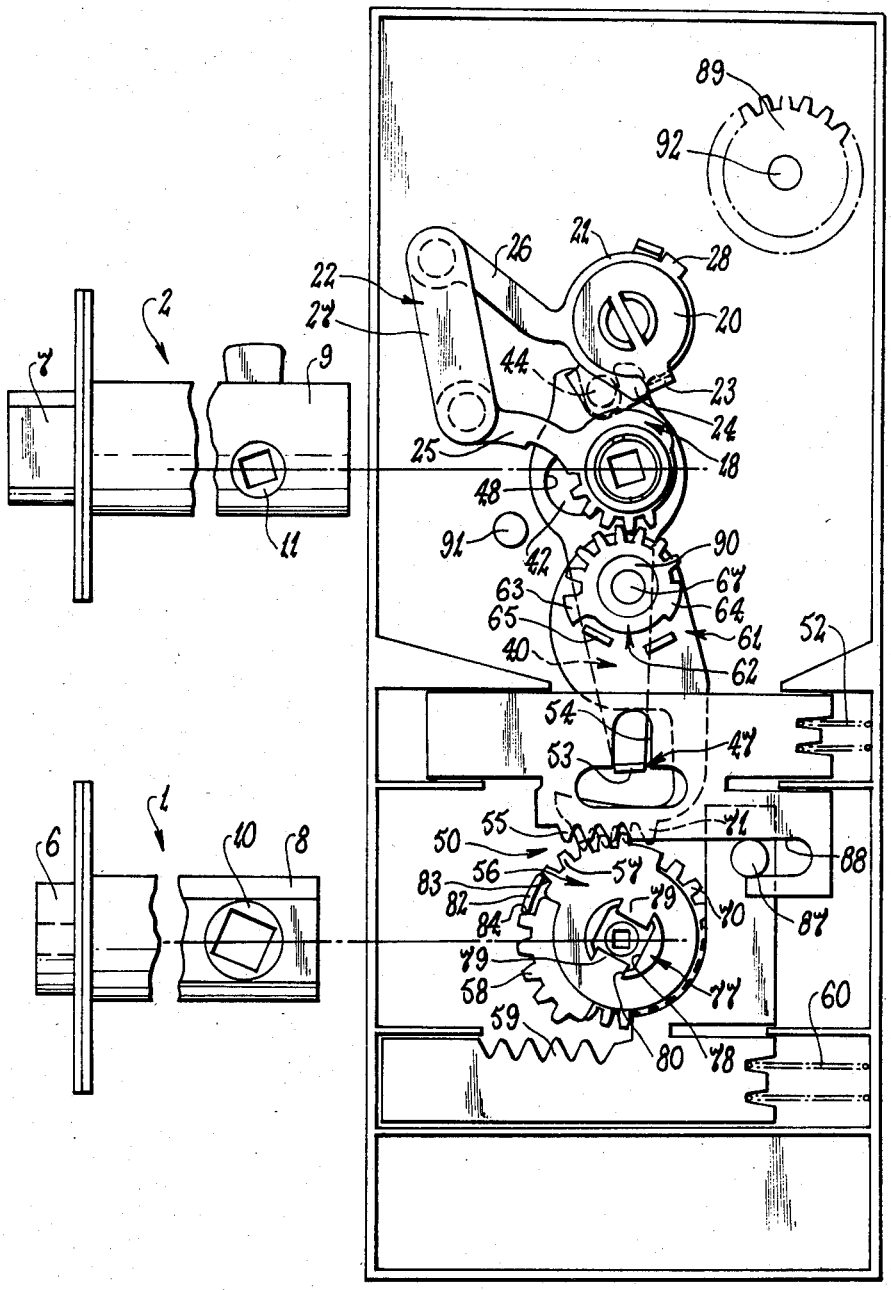
FIG. 5 is a view similar to FIG. 3 but showing the control mechanism operated to partially retract the latchbolt and deadbolt.

By way of example, the aforementioned lost motion means includes a secondary drive member 21 which is mounted for rotation about the same axis as the turn knob drive member 20 and is connected to the lock drive member through a linkage system 22. Cooperative abutments 23 and 24 on the turn knob drive member 20 and secondary drive member 21 respectively are arranged to engage at a particular relative position of the two members 20 and 21 so that one then responds to rotation of the other. In the arrangement shown, the abutments 23 and 24 engage when the turn knob drive member 20 has been turned in one direction through approximately 90° from a rest position. After that engagement, continued turning movement of the turn knob drive member 20 in the same direction causes rotation of the secondary drive member 21 and consequently rotation of the lock drive member 18 (FIG. 5).

The linkage system 22 as shown includes an arm 25 and 26 extending laterally from each of the lock and secondary drive members 18 and 21 respectively, and a link 27 interconnecting the two arms 25 and 26. That is, each end portion of the link 27 is pivotally connected to the outer end portion of a respective one of the arms 25 and 26.

With the arrangement described, the deadbolt 7 may be retracted towards its inoperative position when the turn knob drive member 20 is rotated beyond the 90° movement referred to. When the deadbolt 7 is fully retracted (FIG. 6), rotation of the turn knob drive member 20 in the opposite direction can be operative to move the deadbolt into is operative position. For that purpose, the abutment 23 of the drive member 20 engages a different abutment 28 of the drive member 21, but only after the turn knob drive member 20 has been turned through 90° from the position shown in FIG. 6 which corresponds to the fully retracted position of the deadbolt 7. By way of example, the turn knob drive member 20 may rotate through 180° between its extreme positions, whereas the lock drive member 18 rotates through 90° between its extreme positions.

Linear movement of the latch bolt 6 may be effected through rotation of a square or other non-circular spindle 29 similar to the deadbolt spindle 15. The latchbolt spindle 29 may be driven, in one form of operation, by a latch drive member 30 rotatably mounted on the housing 3 and for that purposes engages within a corresponding non-circular bore 31 and 32 respectively provided in the two drive members 10 and 30 connected to the latch bolt housing 8 and the control mechanism housing 3 respectively. The drive member 30 is preferably connected to an inner latch turn knob 31 or handle through the same drive spindle 29. That is, rotation of the inner knob 31 causes rotation of the latch drive spindle 29 and consequently rotation of the drive member 10 carried by the latch-bolt housing 8 so that the latchbolt 6 is moved linearly. At the same time the latch drive member 30 is rotated and the consequence of that will be hereinafter described.

It is preferred that the latchbolt 6 is retracted in response to rotation of the inner knob 31 in either direction from a rest position. That is not essential however, so that the inner knob 31 may be rotatable in one direction only from the rest position. The aforementioned spring means in the latch bolt assembly 1 may function to return the latchbolt 6 to its operative position, and the inner knob 31 to its rest position, when the delatching turning influence is removed from the knob 31. It is also preferred for a reason hereinafter made clear, that the latch spindle 29 is composed of two parts 32 and 33, and the inner knob 31 and drive member 30 are connected as described to the spindle part 32.

Operation of the latchbolt 6 is also possible from the outside of the door by way of a turn knob 34 or handle, which, for convenience will be hereinafter referred to as the outer knob. That outer knob 34 may be rotatably mounted on a suitable escutcheon 35 or other mounting and connected through the second part 33 of the latch spindle 29 to a drive member 36 which is also rotatably mounted on the control mechanism housing 3. Preferably, the inner and outer knobs 31 and 34 are rotatable about a substantially common axis so that their respective spindle parts 32 and 33 are arranged end to end. The latch drive members 30 and 36 may also rotate about the same axis and are preferably interconnected so that each responds to rotation of the other. Movement of the latchbolt 6 into its inoperative position is therefore possible by rotating the outer knob 34 in either direction from a rest position.

The use of a separated latch spindle 29 and respective drive members 30 and 36 as referred to above is not absolutely essential, but is convenient for the inclusion of particular locking means as hereinafter described. It may be possible to construct an equally satisfactory assembly in which the inner and outer knobs 31 and 34 are directly connected through a one piece spindle.

Locking means (not shown) as referred to is operable to lock the outer knob 34 against rotation relative to its escutcheon 35 or other mounting. The locking means is preferably operable to free the outer knob 34 from driving engagement with the associated part 33 of the latch drive spindle 29 and at the same time secure the outer knob 34 against rotation relative to the escutcheon 35 or other mounting. Such locking means is well known (see for example Australian Pat. No. 410920) so that further description is not necessary. It will be appreciated however, that other forms of locking means may be adopted in lock sets to which the present invention is applicable.

In the construction shown, actuation of the locking means is effected through a spindle 37 which connects that means with a turn button 38 or the like rotatably mounted on the inner knob 31. That turn button 38 is of course accessible at the inside of the door and is preferably arranged to rotate about the same axis as the inner knob 31. In such an arrangement, the locking means spindle 37 may be of square or other non circular section and extends axially through a bore 39 provided through both parts of the latch spindle 29. Clearance is provided between the locking means spindle 37 and that bore 39 to allow relative rotation of the two spindles 29 and 37. The turn button 38 is rotatable relative to the inner knob 31 between a lock position at which the locking means is operative and an unlock position at which that means is not operative.

A drive connection is provided between the latch and deadbolt drive spindles 29 and 15 so that the latchbolt drive spindle 29 will respond to rotation of the deadbolt drive spindle 15. That connection permits retraction of both bolts 6 and 7 by operation of the deadbolt turn knob 13, but it is preferred that independant retraction of the latchbolt 6 is possible through operation of either the inner or outer knobs 31 and 34. It is also preferred that operation of the tumbler lock 14 withdraws the deadbolt 7 but not the latchbolt 6, although it may be effective to release or deactivate the aforementioned locking means.

According to the construction shown, the drive connection includes an actuating lever 40 which is pivotally mounted on the control mechanism housing 3. On one side of that pivot mounting, the lever 40 cooperates with the deadbolt actuating means 12 and on the other side of the pivot mounting it cooperates with transfer means 50 through which the lever 40 is drivably connected to the latch drive spindle 29. The pivotal mounting of the actuating lever 40 may include a boss 41 secured to the plate 4 of the housing so as to be coaxial with the deadbolt drive spindle 15, and which passes through a slot 42 formed in the lever 40. The slot 42 is arranged to allow some degree of lateral movement of the lever 40 relative to the boss 41 before it swings about the axis of that boss 41. Such an arrangement can be adopted to allow for different movements of the parts to which the ends of the lever 40 are connected.

Connection between the actuating lever 40 and the deadbolt actuating means 12 may be effected, as shown, through a drive plate 43 which is mounted for rotation about the same axis as the turn knob drive member 20. That drive plate 43 is arranged to respond to rotation of the turn knob drive member 20 at the same time as the secondary drive member 21, although other arrangements may be adopted. Cooperation between the drive plate 43 and the actuating lever 40 may be effected, as shown, by means of a pin 44 connected to the drive plate 43 and which engages within a slot 45 formed in an end of the actuating lever 40. The arrangement is such that rotation of the drive plate 43 causes swinging movement of the lever 40.

In the particular construction shown, the abutment 23 of the drive member 20 is in the form of a depending lug which projects across and beyond the periphery of the drive member 21. An abutment 46 of the drive plate 43 is arranged in the path of movement of the projecting abutment 23 so as to be engaged by that abutment 23 at the same time as the abutment 24 is engaged.

When the deadbolt turn knob 13 is turned in the release direction beyond the position at which the turn knob drive member 20 engages the drive plate 43—e.g., as shown in FIG. 5—the resulting movement of the drive plate 43 causes swinging movement of the actuating lever 40. Initially however, that swinging movement is about a fulcrum 47 formed at the connection between the lever 40 and the transfer means 50 and that is permitted by the slotted pivotal mounting of the lever 40. In that regard see the change in position of the lever 40 as between FIGS. 3 and 5. The end 48 of the lever slot 45 eventually engages the pivot boss 41 so that further movement of the turn knob 13 in the same direction causes the lever 40 to swing about the axis of the boss 41 and thereby cause operation of the transfer means 50.

Similarly, when the turn knob 13 is turned in the reverse direction from its extreme position remote from the rest position, the first part of that movement has no influence on the transfer means 50. Obviously other techniques may be employed to achieve lost motion between the actuating lever 40 and the transfer means 50.

In the event that the deadbolt 7 is withdrawn by operation of the tumbler lock 14, that will not influence the transfer means 50 and consequently the latchbolt 6 will remain projected. As previously stated, the lock drive member 18 turns through approximately 90° from the deadbolt operative position to the deadbolt inoperative position. During that movement it will cause corresponding movement of the turn knob drive member 20 through the linkage system 22. At the end of that movement, the turn knob drive member 20 will be at or near the position at which it will influence the drive plate 43, but further rotation of that drive member 20 in the same direction is necessary to turn the drive plate 43 and consequently operate the transfer means 50. Thus, in the construction shown, operation of the tumbler lock 14 does not cause movement of the latchbolt 6, but it does influence the aforementioned locking means as hereinafter described.

Figure 3:
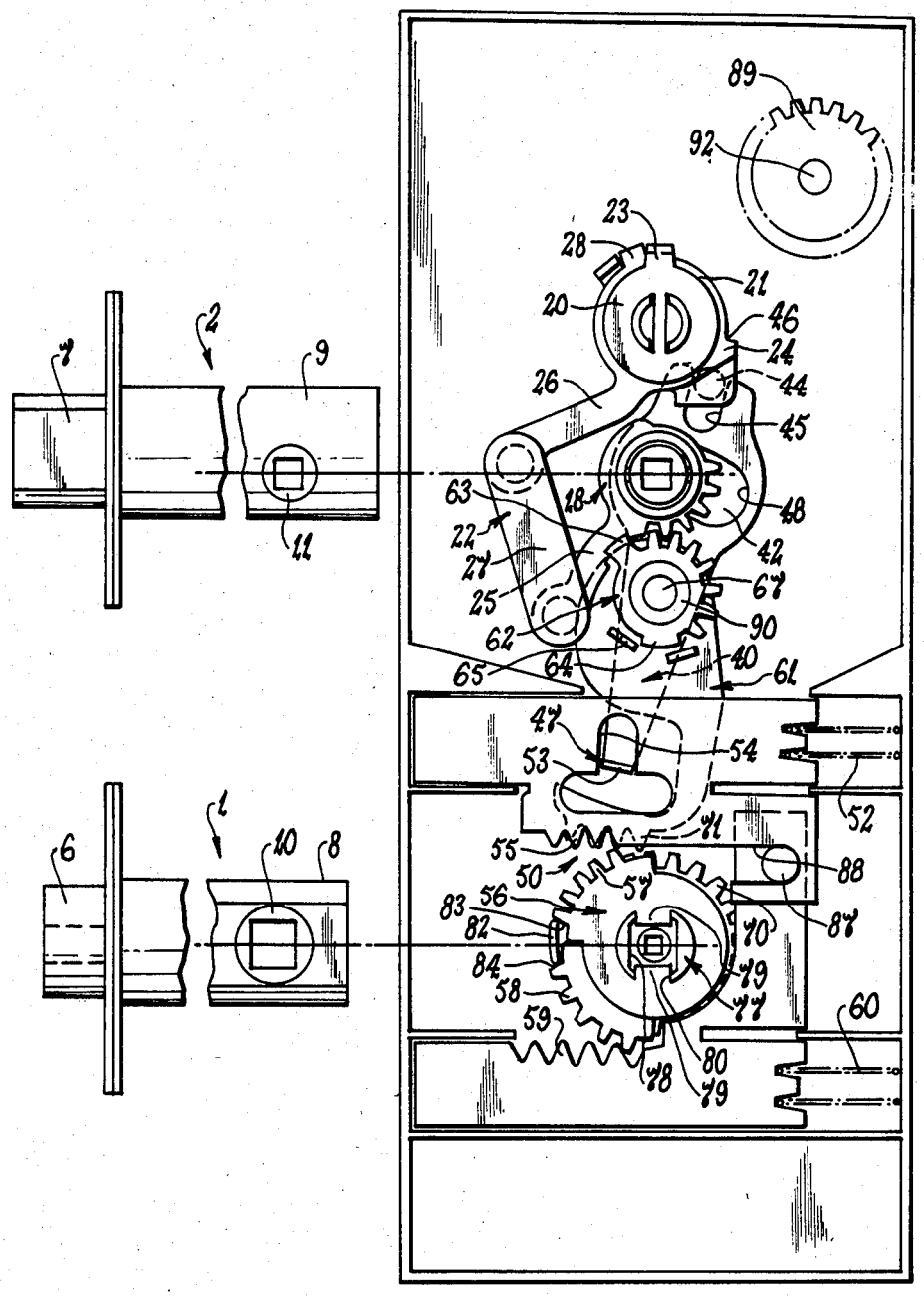
FIG. 3 is a view of the control mechanism of the FIG. 1 embodiment and associated latchbolt and deadbolt, showing the mechanism in the condition at which the two bolts are extended and locking means associated with the latchbolt has been activated.
Figure 6:
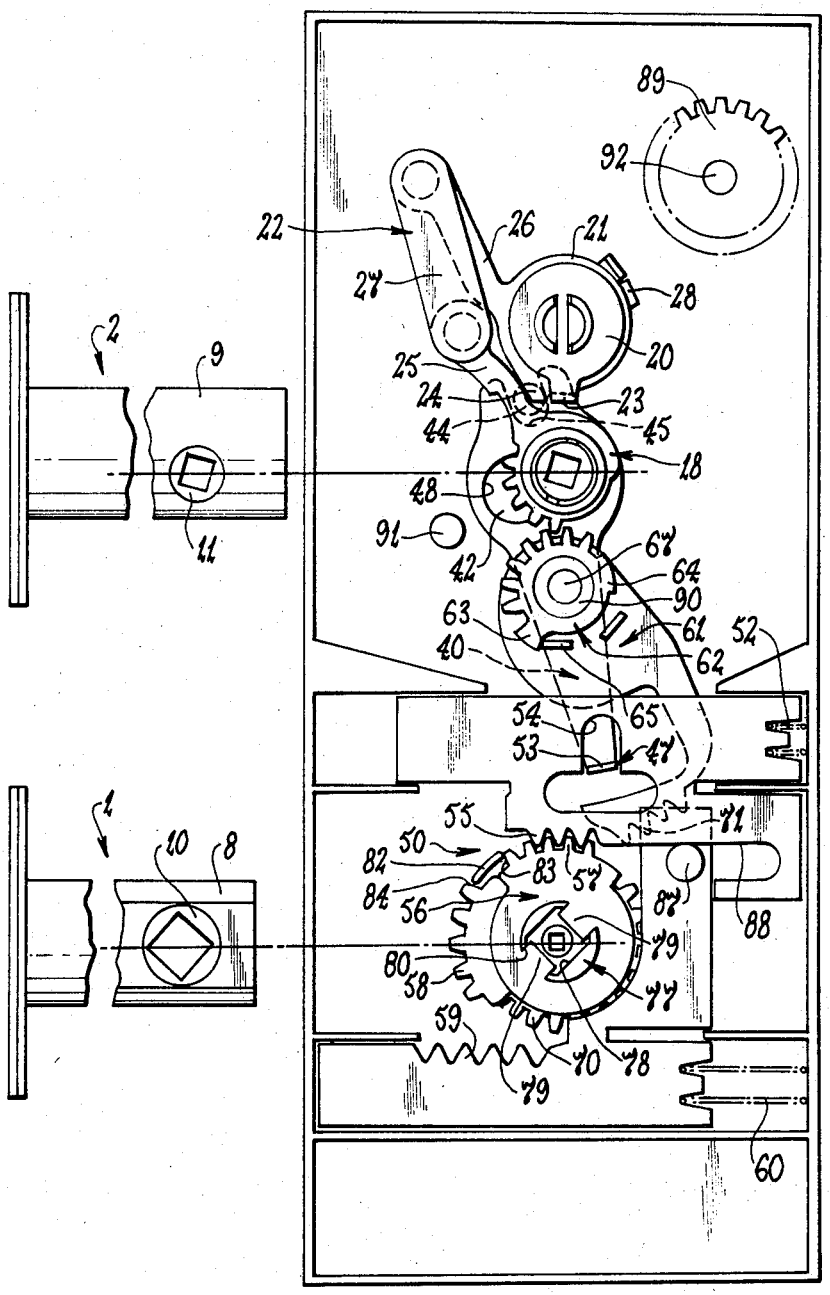
FIG. 6 is a view similar to FIG. 5 but showing the two bolts in the fully retracted position.

The transfer means 50 of the construction shown includes a transfer member 51 which is slidably mounted on the control mechanism housing 3 for linear movement (FIGS. 3, 5 and 6). Spring means 52 may urge that member 51 into a rest position (FIG. 3) which corresponds to the operative position of the latchbolt 6.

A lug 53 connected to the actuating lever 40 may locate within a slot 54 or recess of the transfer member 51 so that the transfer member 51 is moved along a straight path in response to swinging movement of the lever 40 about the axis of the boss 41.

A rack and pinion drive connection is preferably provided between the transfer member 51 and latch drive spindle 29, but other equally acceptable drive connections may be available. The rack 55 may be provided on the transfer member 51 as shown, and the pinion 56 is connected to the latch drive members 30 and 36 for rotation therewith. It is further preferred that the pinion 56 comprises a gear segment 57 which is connected against rotation relative to the latch drive member 36, and as shown may be an integral part of that drive member.

The rack and pinion arrangement, may be such that the rack 55 and gear segment 57 remain in engagement at all times. Thus, when the actuating lever 40 pivots in one direction the resulting movement of the transfer member 51 from its rest position causes the gear segment 57 to rotate in a direction such that the latch drive spindle 29 draws the latch bolt 6 into its inoperative position. Return rotation of the latch bolt spindle 29 moves the transfer member 51 and actuating lever 40 back to their original positions, but does not influence the position of the deadbolt drive spindle 15 for a reason hereinafter explained.

It is preferred that the latch bolt 6 can be retracted as a consequence of rotation of either the inner or outer knobs 31 and 34 in either direction. For that purpose, it is preferable to provide a second rack 59 and cooperative pinion arrangement. The rack 55 and cooperating gear segment 57 will be sufficient for one direction of rotation, but because of dimensional and other constraints operative engagement between the rack 55 and gear segment 57 cannot be maintained over the full range of possible rotation of the latch drive spindle 29. A second gear segment 58 may then be arranged to be part of the pinion 56 and engages with the second rack 59. The gear segment 58 maybe of the same form as the first gear segment 57 and rotates with that gear segment. In fact, the two gear segments 57 and 58 may be formed integral with one another. The two racks 55 and 59 are preferably located on respective opposite sides of the latch drive spindle 29 as shown and are interconnected as hereinafter described. It is further preferred that the second rack 59 is slidable in the same direction as the first rack 55 and is also influenced by a spring 60 into a rest position which corresponds to the operative position of the latchbolt 6.

Each gear segment 57 and 58 is arranged to engage with its respective rack 55 and 59 when rotated beyond the position at which it places that rack in its rest position. That is, assuming the direction of rotation of the gear segment remains as it was for moving the rack into the rest position. Reverse rotation of course re-engages the rack 55 or 59 with the gear segment 57 or 58 respectively so that rack can be moved away from its rest position.

When the second rack 59 is moved away from its rest position by the engaging gear segment 58, the interconnection between the two racks 55 and 59 is such that the first rack 55—i.e., the transfer member 51—follows movement of the second rack 59 so that both move away from their respective rest positions. As a result, the actuating lever 40 is caused to swing about its pivot as described above. On the other hand, the interconnection preferably permits the transfer member 51 (rack 55) to move from its rest position without causing corresponding movement of the second rack 59.

It will be understood from the foregoing that operation of the actuating lever 40 by movement of the deadbolt spindle 15 will cause rotation of the latch drive spindle 29 and therefore delatching movement of the latch bolt 6. That result is achieved without any movement of the second rack 59, which becomes operative only as a result of direct rotation of either the inside or outside knob 31 and 34 respectively and then only when that knob 31 or 34 is rotated in one particular direction.

Means is also provided in the construction shown, whereby the aforementioned locking means can be deactivated by operation of the deadbolt turn knob 13 or tumbler lock 14. In particular, the arrangement is such that the locking means is deactivated in response to movement of the deadbolt 7 into the retracted or inoperative position.

The aforementioned means may include a locking lever 61 which is pivotally mounted on the control mechanism housing 3 for swinging movement between lock activate and deactivate positions. Swinging movement of the locking lever 61 is preferably initiated through a lost motion connection between the aforementioned lock drive member 18 and the locking lever 61. In the form shown, that lost motion connection includes a gear member 62 mounted for rotation relative to the locking lever 61 and having abutments 63 and 64 engagable with a projecting part 65 of the lever 61. Preferably, the gear member 62 is rotatable about the pivotal axis of the locking lever 61, but that is not essential. Teeth of the gear member 62 cooperate with a gear segment 66 connected to or forming part of the lock drive member 18 so that the two members 18 and 62 rotate together.

With the above arrangement, the gear member 62 does not engage with and cause movement of the locking lever 61 during initial movement of the gear member 62 from a rest position which corresponds to the operative position of the deadbolt 7. As will be apparent from a comparison of FIGS. 3 and 5, the gear member 62 rotates through a distance before the abutment 63 engages the lever part 65 and it is only after such engagement that the lever 61 responds to rotation of the gear member 62 by swinging about its pivotal mounting. By way of example, the gear member 62 may move through approximately 50° before the locking lever 61 is driven about its pivotal mounting, which in the construction shown includes a pin 67 secured to the housing plate 4 and located in a hole 68 of the lever 61.

Figure 7:
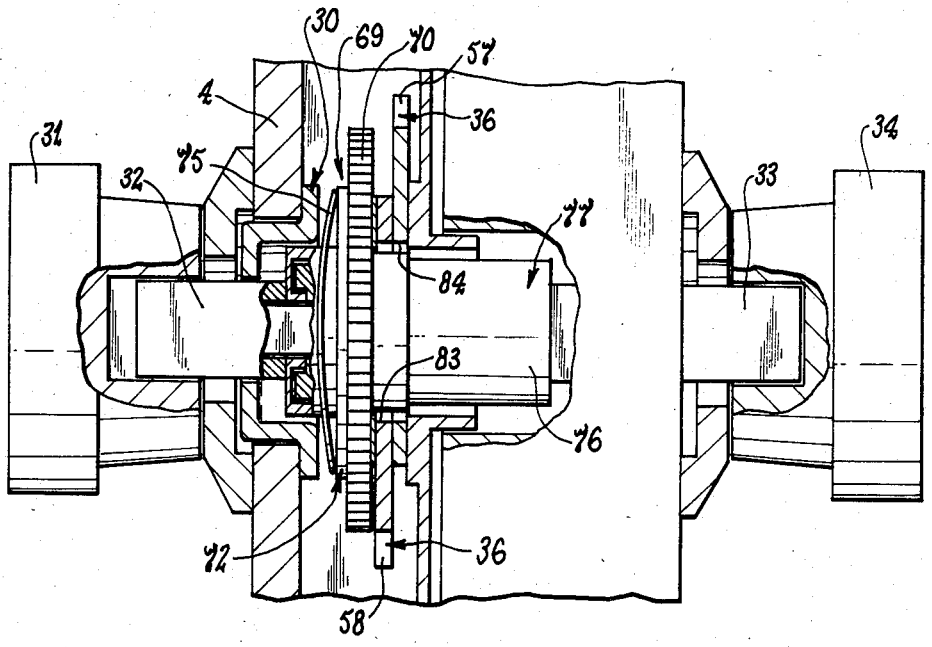
FIG. 7 is a side elevational view of components of the control mechanism associated with the latch drive spindle.

The drive connection between the locking lever 61 and the locking spindle 37 preferably includes clutch means 69 (FIG. 7) as hereinafter described. It is also preferred that the drive connection includes a gear wheel 70 mounted for rotation about the axis of the spindle 37 and a gear segment 71 on the locking lever 61 which is engagable with that gear wheel 70. The gear wheel 70 is rotatable relative to the locking spindle 37 and the clutch means 69 provides a connection between that gear wheel 70 and the spindle 37.

In one form as shown in the drawings (FIGS. 4 to 7), the clutch means 69 includes a ratchet plate 72 which is connected to the locking means spindle 37 for rotation with that spindle 37 and has a series of ratchet teeth 73 on one face. Corresponding ratchet teeth 74 (FIG. 1) are provided on an opposed face of the gear wheel 70 and suitable spring means 75 urges the ratchet plate 72 and gear wheel 70 into engagement such that the ratchet teeth 73 and 74 drivably cooperate. On the other hand, the spring means 75 allows the ratchet teeth 73 and 74 to disengage if the ratchet plate 72 is unable to turn with the gear wheel 70 as hereinafter described. The ratchet plate 72 is preferably located between the two parts 32 and 33 of the latch drive spindle 29 so that it can be directly mounted on the locking spindle 37 and it is for that reason the spindle 29 is formed of two parts. The latch drive members 30 and 36 are interconnected outside the periphery of the gear wheel 70 so that the two parts 32 and 33 of the latch drive spindle 29 turn as a single unit.

Figure 4:
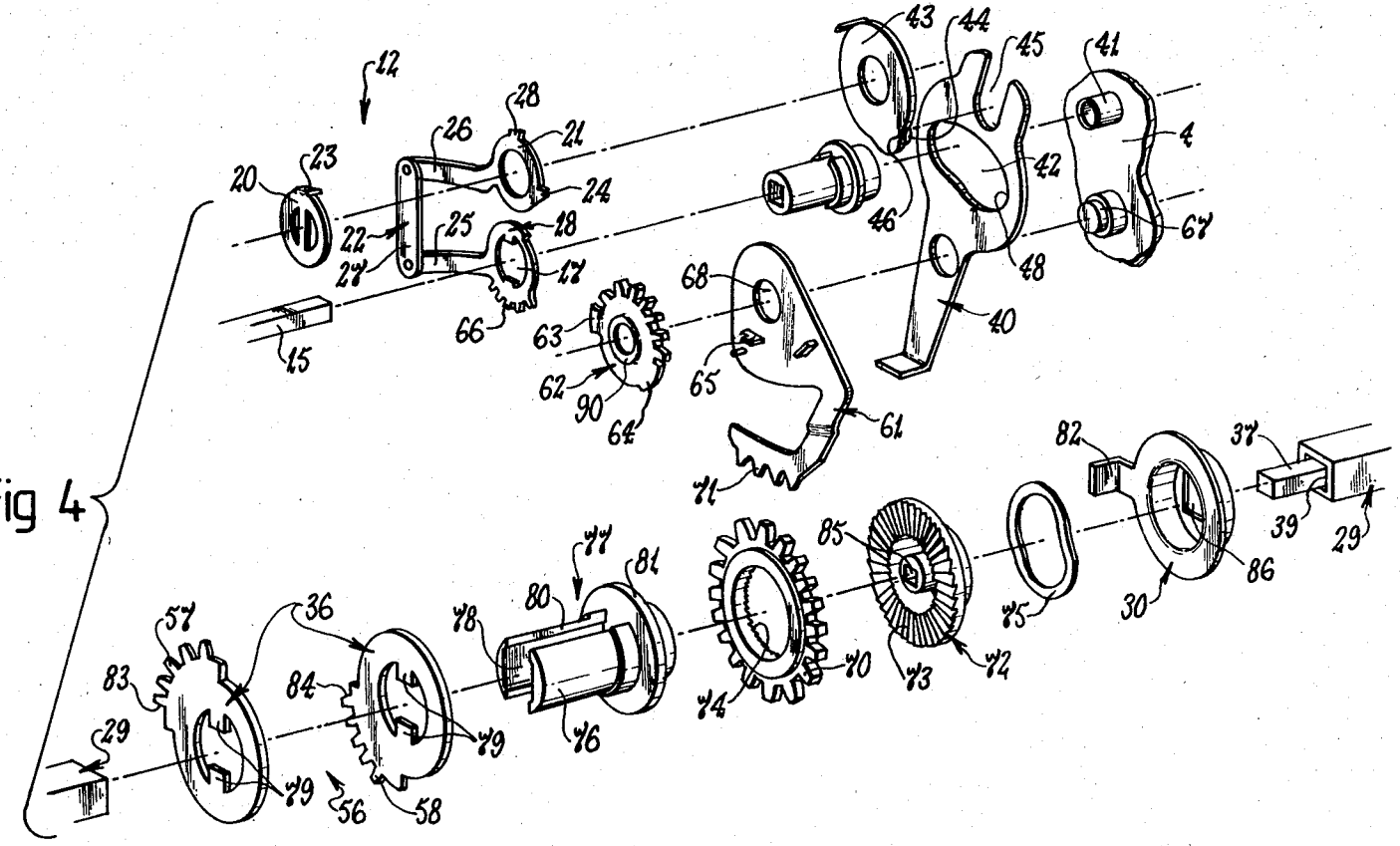
FIG. 4 is an exploded view of some of the components of the control mechanism shown in FIG. 3.

The various components referred to above can be mounted and relatively arranged in any appropriate manner. In the example shown however, the gear segments 57 and 58 of the pinion 56 are mounted on a barrel section 76 of a hub 77 (FIGS. 1 and 4). The hub 77 has a bore 78 through which the locking spindle 37 passes with clearance and which is complementary in shape to the latch spindle part 33 so that the hub 77 is non-rotatably mounted on that part 33. The gear segments 57 and 58 are drivably connected to the hub 77 by lugs 79 which engage within longitudinal slots or grooves 80 of the hub barrel section 76. The gear wheel 70 is rotatably mounted on an enlarged flange 81 of the hub 77 (FIG. 4).

As previously described, the drive member 30 is non-rotatably mounted on the latch spindle part 32 and for that purpose has a bore 86 of complementary shape to the cross section of the spindle part 32. The drive member 30 is located on the side of the gear wheel 70 remote from the pinion gear segments 57 and 58 the ratchet plate 72 is interposed between it and the gear wheel 70. The spring means 75 is in turn interposed between the drive member 30 and the ratchet plate 72. The drive member 30 has a lug 82 located outwardly of the gear wheel 70 and the ratchet plate 72 and arranged to extend across those components and beyond the side of the gear wheel 70 adjacent the gear segments 57 and 58. The lug 82 locates between adjacent and spaced ends 83 and 84 of the gear segments 57 and 58 so that drive can be transmitted between those gear segments and the drive member 30. The ratchet plate 72 has a bore 85 which is complementary in shape to the locking spindle 37 and is the only component which is not rotatable relative to that spindle 37.

When the locking lever 61 is swung from the lock activate position (FIG. 3), engagement between the gear segment 66 of that lever 61 and the gear wheel 70 causes the gear wheel 70 to rotate in response to the lever 61 movement. The gear wheel 70 in turn drives the ratchet plate 72 through the inter-engaging teeth 73 and 74 and consequently the locking spindle 37 in a direction such that the locking means is deactivated. When the locking lever 61 has been moved to its extreme position at which the locking means is deactivated (FIG. 6), it is preferred that it disengages from the gear wheel 70 for a reason hereinafter made clear.

With the foregoing arrangement, the locking means is deactivated during the latter part of movement of the deadbolt 7 into its inoperative position. That is, there is automatic deactivation of the locking means so that the latchbolt 6 can be thereafter operated at will by either the inner or outer knobs 31 and 34.

A lock set as described can be operated in a variety of ways. The foregoing description has assumed that both bolts 6 and 7 will be in their operative position and the locking means activated. Under another set of circumstances however, the deadbolt 7 may be retained retracted while the latchbolt 6 is in its operative position. Such a condition is shown in FIG. 8.

When the bolts 6 and 7 have been simultaneously retracted in the manner described above, release of the turning influence on the latch drive spindle 29 will result in the transfer member 51 being urged back into its rest position by the associated spring 52. The gear segment 57 engaging the transfer member rack 55 is thereby turned to move the latch spindle 29 in a direction to project the latchbolt 6, which may be biased in the same direction by its own spring means.

During that return movement of the transfer member 51 the actuating lever 40 will be swung back towards its original rest position so that the drive plate 43 and turn knob drive member 20 are caused to rotate back to their original positions. That rotation however, does not influence the lock drive member 18 because of the aforementioned lost motion means. Thus, the deadbolt drive spindle 15 remains stationary and as a consequence the deadbolt 7 remains in its withdrawn position. Also, the position of the locking lever 61 is unaffected by the latch spindle 29 movement because of its lack of engagement with the gear wheel 70 so that the locking means remains deactivated. A comparison of FIGS. 6 and 8 will assist in understanding the foregoing.

Figure 8:
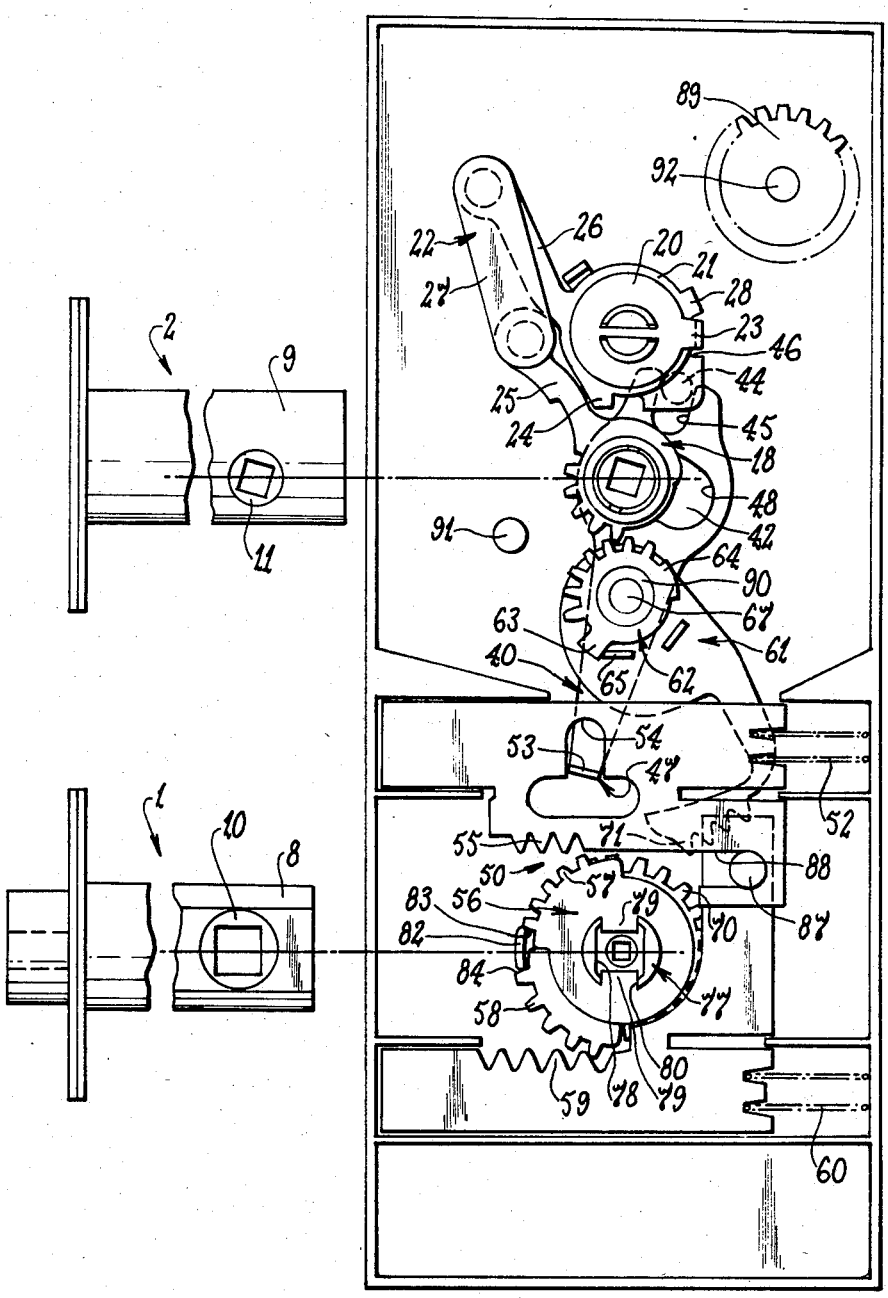
FIG. 8 is a view similar to FIG. 6 but showing the latchbolt extended.
Figure 9:
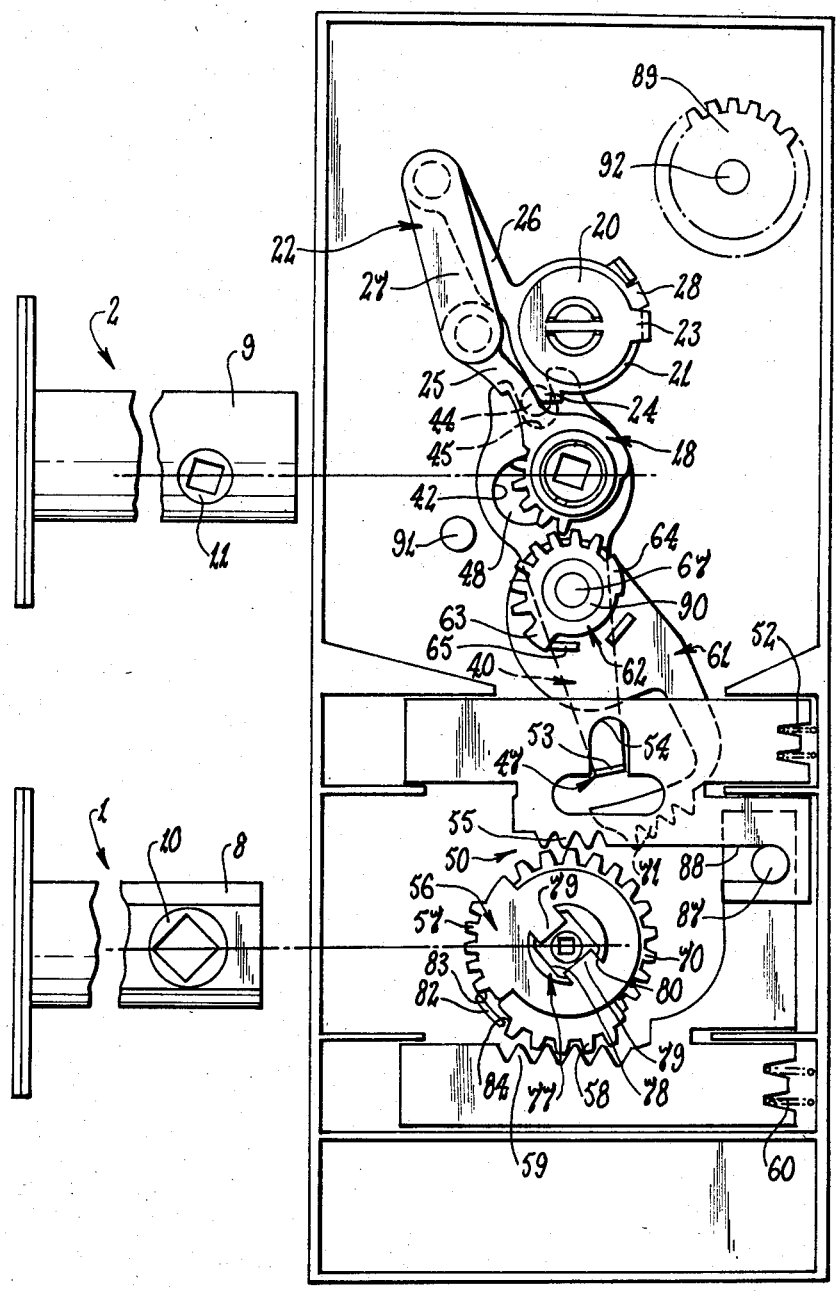
FIG. 9 is a view similar to FIG. 8 but showing the latchbolt retracted.

The latchbolt 6 can be retracted at will by operation of either knob 31 or 34 while the FIG. 8 condition remains. FIG. 9 shows the condition of the various control mechanism components when the latchbolt 6 is retracted, under the FIG. 8 condition, by operation of the inner knob 31. In the example shown, the knob 31 has been turned clockwise so that the rack 59 drives the pinion 56 and the transfer member 51 is caused to follow the movement of the rack 59. In that regard, a pin 87 secured to the rack 59 is slidably located in a slot 88 of the transfer member 51 and, in the FIG. 8 condition, engages an end of the slot 88 so that movement of the rack 59 away from its rest position causes corresponding movement of the transfer member 51. As shown by FIG. 6 however, the pin 87 and slot 88 are arranged to allow the transfer member 51 to move in that same direction without causing corresponding movement of the rack 59. Obviously, other forms of connection between the rack 59 and transfer member 51 could be adopted to achieve the same result.

In the condition shown by FIG. 8, the deadbolt 7 remains inoperative and the locking means is deactivated even though the latchbolt 6 may be retracted and extended by operation of either one of the knobs 31 and 34. The locking means can be activated however, by independant operation of the turn button 38 or by operation of the turn knob 13 or tumbler lock 14 to extend the deadbolt 7. In the former case, the deadbolt 7 condition remains unaffected because the gear wheel 70 and locking lever 61 are not in engagement. In the latter case, the gear member 62 associated with the deadbolt drive spindle 15 rotates with that spindle 15 and during part of that rotation engages and moves the locking lever 61 so that it in turn engages and rotates the gear wheel 70. The gear wheel 70 causes rotation of the ratchet plate 72 and consequently the locking means spindle 37 so that the locking means is activated.

If the locking means is activated by operation of the turn button 38 as described above, subsequent movement of the deadbolt 7 into the operative position will not affect the locking means condition because of the clutch means 69. That is, the locking lever 61 will engage and cause rotation of the gear wheel 70, but corresponding rotation of the ratchet plate 72 will be prevented by the condition of the locking means. The clutch spring 75 therefore allows the two sets of ratchet teeth 73 and 74 to ramp out of engagement so that the gear wheel 70 can turn relative to the ratchet plate 72.

It is preferred that a lock set as described can be modified to allow for a change of hand of operation. For that purpose, the mechanism housing 3 may be arranged to allow convenient reversal or inversion of the positions of various components. That is, some of the components are simply turned upside down so that their respective positions are the mirror image of their original positions.

Figure 10:
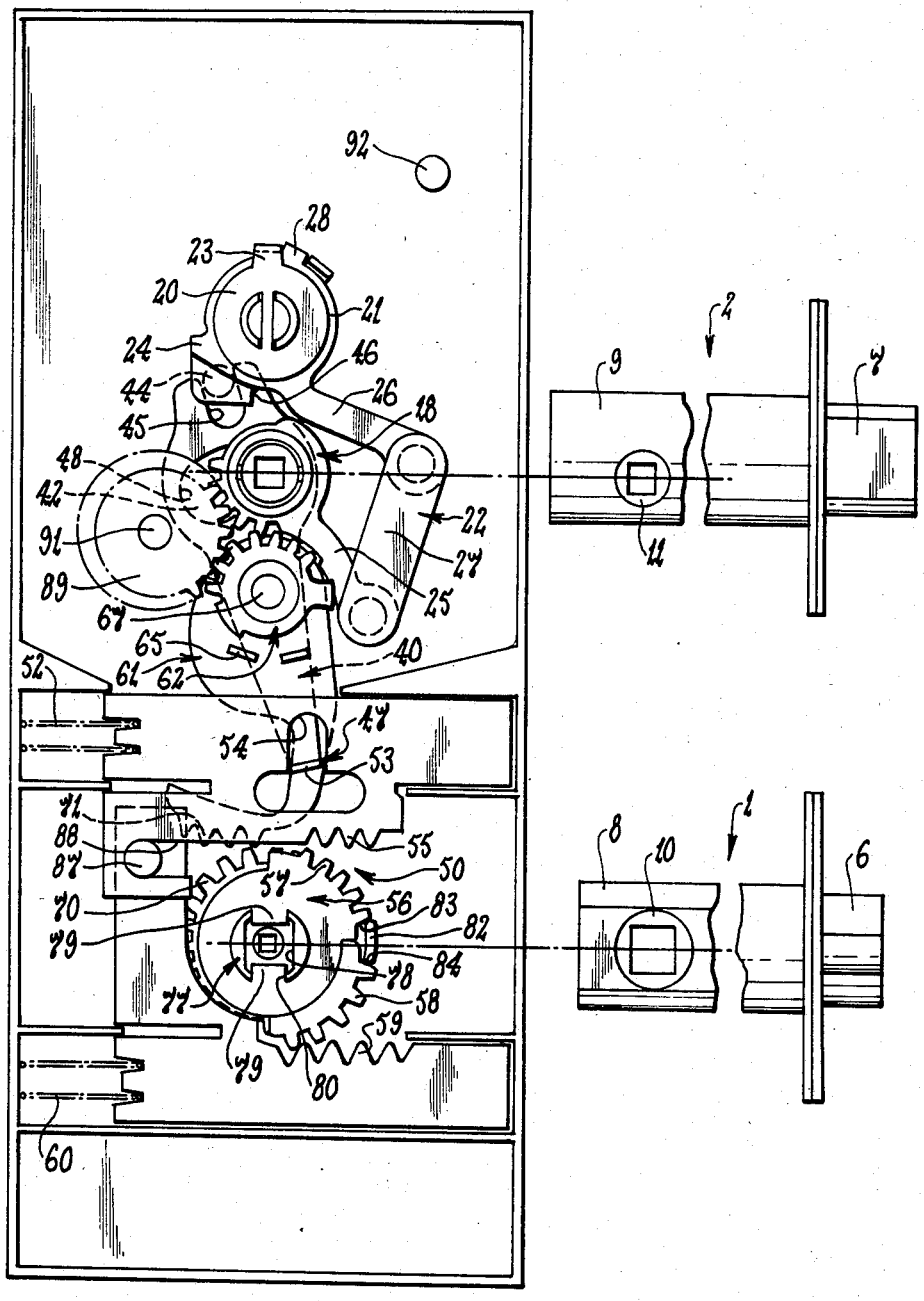
FIG. 10 is a view similar to FIG. 3 but showing the control mechanism adjusted for a different hand of operation.

FIGS. 1 to 9 show the lock set as adjusted for what is termed right hand operation. FIG. 10 shows the same lock set converted to left hand operation and shows the various control mechanism components in positions comparable to those of FIG. 3. The change from right to left hand operation is effected very simply and involves inversion of some components as described below and addition of a component not included in the right hand operation mechanism.

In adjusting the mechanism from the FIG. 3 to the FIG. 10 condition, the linkage system 22, the actuating lever 40, and the two racks 55 and 59 and the associated pinion 56, have all been inverted or turned upside down. The rotational relationship between the turn knob drive member 20 and the associated drive plate 43 has also been changed.

In the construction particularly described, the locking spindle 37 is rotated in the same direction for locking purposes when the lock set is arranged for either right or left hand operation. As a consequence, the gear wheel 70 associated with that spindle 37 must rotate in the same directions for locking and unlocking respectively, regardless of the hand of operation of the lock set. It is therefore necessary for the locking lever 61 to maintain the same association with the gear wheel 70 for both hands of operation, but the rotation of the deadbolt spindle 15 is reversed with a change of hand so that means must be provided to compensate for that reversal.

For the foregoing reason, in the construction shown, an idler gear 89 is provided between the gear member 62 and the gear segment 66 of the lock drive member 18. In the FIG. 3 condition, the gear member 62 and gear segment 66 engage directly. In the change of hand condition as shown by FIG. 10 however, they engage through the added idler gear 89 to achieve suitable relative directions of rotation. For that purpose the gear member 62 is arranged so that its axial position relative to the gear segment 66 is changed with its reversed location so that the teeth of those components cannot engage. That is, in the FIG. 10 condition, a boss 90 (FIG. 4) of the gear member 62 is positioned underneath and supports the gear member 62 above the position at which it can engage with the gear segment 66. A pin 91 fixed to the housing plate 4 provides a rotatable mounting for the idler gear 89.

The idler gear 89 can be located at an appropriate position within the mechanism housing 3 for use when required and in the construction shown a storage pin 92 is provided for that purpose. That is, the gear 89 is simply transferred between a stored position pin 92 and an operative position pin 91 as necessary.

The construction particularly described can be modified in a number of ways without departing from the concept of the invention. For example, the facility to operate the locking means independant of the deadbolt actuator means may be omitted. That is, the turn button 38 may be omitted so that rotation of the locking spindle 37 is achieved exclusively through operation of the deadbolt actuating means 12. Under those circumstances, the clutch 69 is not required so that the gear wheel 70 can be connected direct to the spindle 37 rather than through a ratchet plate 72.

It will be apparent from the foregoing description that a lock set as described has several valuable advantages. The versatility of the lock set is important as is the fact that single handed operation is possible through the deadbolt actuating means. Those advantages are achieved in a compact and relatively inexpensive construction requiring only one tumbler lock for high security. Furthermore, reversal of hand is a simple operation which can be carried out on site.

Various alterations, modifications and/or additions may be introduced into the constructions and arrangements of parts previously described without departing from the spirit or ambit of the invention as defined by the appended claims.

Having now described my invention what I claim as new and desire to secure by Letters Patent is:

1. Lock set control mechanism including, a housing, latch bolt actuator means mounted on said housing and being movable relative thereto between latch bolt operative and inoperative positions, deadbolt actuator means mounted on said housing and being movable relative thereto between deadbolt operative and inoperative positions, a lock actuator mounted on said housing and being operable to cause operation of locking means which renders the latch bolt actuator means inoperable, said lock actuator is connected to the deadbolt actuator means to activate or deactivate said locking means according to whether said deadbolt actuator means is moved into its deadbolt operative or inoperative position respectively, and drive means interconnecting the two said bolt actuator means so that each is responsive to operation of the other such that movement of either said bolt actuator means towards its respective bolt inoperative position causes corresponding movement of the other said bolt actuator means, wherein said drive means includes transfer means which responds to operation of either said bolt actuator means to cause operation of the other said bolt actuator means and a lost motion connection provided between said transfer means and said deadbolt actuator means, said lost motion connection is operative to disconnect the deadbolt actuator means from the influence of the transfer means when the deadbolt actuator means is in the deadbolt inoperative position and said latchbolt actuator means is moved between the latchbolt operative and inoperative positions, but drivably connects the deadbolt actuator means to the transfer means when the deadbolt actuator means is operated to move towards the deadbolt operative position and wherein said transfer means includes a rack slidably mounted on said housing and a pinion mounted for rotation with said latchbolt actuator means and drivably engaging said rack.

2. Control mechanism according to claim 1, wherein said deadbolt actuator means includes an inner part and an outer part each of which is operable independant of the other, and said drive means connects said inner part and the latch bolt actuator means so that said inner part and said latch bolt actuator means each responds to movement of the other towards the respective bolt inoperative position.

3. Lock set control mechanism including, a housing, latch bolt actuator means mounted on said housing and being movable relative thereto between latch bolt operative and inoperative positions, deadbolt actuator means mounted on said housing and being movable relative thereto between deadbolt operative and inoperative positions, a lock actuator mounted on said housing and being operable to cause operation of locking means which renders the latch bolt actuator means inoperable, said lock actuator is connected to the deadbolt actuator means to activate or deactivate said locking means according to whether said deadbolt actuator means is moved into its deadbolt operative or inoperative position respectively, and drive means interconnecting the two said bolt actuator means so that each is responsive to operation of the other such that movement of either said bolt actuator means towards its respective bolt inoperative position causes corresponding movement of the other said bolt actuator means, wherein said drive means includes a rack and a pinion which are relatively arranged for drivable engagement, said rack is slidably mounted on said housing and is connected to said to said deadbolt actuator means so as to move longitudinally in response to operation of that means, said pinion is rotatably mounted on said housing and is connected to said latchbolt actuator means so as to rotate in response to operation of that means, and each said actuator means is operable as a consequence of operation of the other through driving engagement between said rack and said pinion.

4. Control mechanism according to claim 3, wherein there are two said racks, said pinion is located between said racks and has two gear segments each of which is drivably engagable with a respective said rack during part of the available range of rotation of said pinion, and said gear segments are relatively arranged so that each is disengaged from its respective rack while the other gear segment and rack are drivably engaging.

5. Control mechanism according to claim 4, wherein said racks are spring influenced into a rest position and each is movable away from that position in response to rotation of said pinion in a respective one of two directions of rotation, one said rack is connected to said deadbolt actuator means through interconnection with the other said rack, and said interconnection is such that said other rack moves away from the rest position in response to movement of said one rack in the same direction, but said one rack does not move away from the rest position in response to movement of said other rack in that direction.

6. Control mechanism according to claim 3, wherein said drive means includes a lever, a pivot connection is provided between said lever and said housing, one end portion of said lever engages with said rack so that said lever pivots in response to longitudinal movement of said rack and vice versa, and the other end portion of said lever is engagable by said deadbolt actuator means so that said lever pivots in response to operation of said deadbolt actuator means.

7. Control mechanism according to claim 6, wherein said pivot connection includes lost motion means whereby the lever can swing to a limited extent about its connection with said rack and simultaneously move laterally relative to the axis of said pivot connection, the arrangement being such that said lever does not influence the position of said rack when the deadbolt actuator means is moved towards the deadbolt operative position.

8. Control mechanism according to claim 6, wherein said deadbolt actuator means includes an inner part and an outer part, and said inner part only is engagable with said lever other end to cause pivotal movement of that lever.

9. Control mechanism according to claim 2, wherein each said part is connected to said lock actuator so that movement of either said part towards the deadbolt inoperative position causes said lock actuator to operate in the locking means deactivate mode.

10. Control mechanism according to claim 9, wherein movement of either said part towards the deadbolt operative position causes said lock actuator to operate in the locking means activate mode.

11. Lock set control mechanism including, a housing, latch bolt actuator means mounted on said housing and being movable relative thereto between latch bolt operative and inoperative positions, deadbolt actuator means mounted on said housing and being movable relative thereto between deadbolt operative and inoperative positions, a lock actuator mounted on said housing and being operable to cause operation of locking means which renders the latch bolt actuator means inoperable, said lock actuator is connected to the deadbolt actuator means to activate or deactivate said locking means according to whether said deadbolt actuator means is moved into its deadbolt operative or inoperative position respectively, and drive means interconnecting the two said bolt actuator means so that each is responsive to operation of the other such that movement of either said bolt actuator means towards its respective bolt inoperative position causes corresponding movement of the other said bolt actuator means, wherein said lock actuator includes a gear wheel rotatably mounted on said housing and which is drivably connectable with said locking means, a locking lever is pivotally mounted on said housing and has a gear segment at one end thereof which is movable into and out of driving engagement with said gear wheel as a consequence of movement of said locking lever about its pivotal mounting, said pivotal movement causing rotation of said gear wheel while said locking lever and said wheel are engaging, and a drive connection is provided between said locking lever and said deadbolt actuator means so that said locking lever is caused to move about its pivotal mounting in response to movement of said deadbolt actuator means.

12. Control mechanism according to claim 11, wherein said drive connection includes linkage means connected to said deadbolt actuator means so as to move in response to movement of said deadbolt actuator means towards either said position thereof, a gear member which rotates in response to said linkage means movement, and a lost motion connection between said gear member and the locking lever so that said locking lever is caused to move about its pivotal mounting during part only of the rotation of said gear member.

13. Control mechanism according to claim 12, wherein means is provided for adjusting said mechanism to operate with a lock set of either right or left hand operation, said adjusting means includes means for mounting said linkage means, said gear member, said locking lever and said latchbolt actuator means so that they may be inverted relative to said housing for a change of hand adjustment, and an idler gear which is connectable between said linkage means and said gear member for one said hand of operation but not the other.

14. Control mechanism according to claim 1, wherein said lock actuator is connected to said deadbolt actuator means through lost motion means whereby said lock actuator is operated during a final stage only of movement of the deadbolt actuator means towards the deadbolt inoperative position.

15. Lock set control mechanism including, a housing, latch bolt actuator means mounted on said housing and being movable relative thereto between said latch bolt operative and inoperative positions, deadbolt actuator means mounted on said housing and being movable relative thereto between deadbolt operative and inoperative positions, a lock actuator mounted on said housing and being operable to cause operation of locking means which renders the latch bolt actuator means inoperable, said lock actuator is connected to the deadbolt actuator means to activate or deactivate said locking means according to whether said deadbolt actuator means is moved into its deadbolt operative or inoperative position respectively, and drive means interconnecting the two said bolt actuator means so that each is responsive to operation of the other such that movement of either said bolt actuator means towards its respective bolt inoperative position causes corresponding movement of the other said bolt actuator means, wherein means is provided for adjusting said mechanism to operate with a lock set of either right or left hand operation, said means includes means for mounting components of said mechanism so they can be inverted relative to said housing for a change of hand operation and a gear train to which an idler gear is added or removed according to the desired said hand of operation.

16. A lock set including, a latch bolt and a deadbolt each of which is movable between operative and inoperative positions, control mechanism for both said bolts including separate actuator means for each said bolt and each being operable to move the respective said bolt between its operative and inoperative positions, locking means operative to render the latchbolt actuator means inoperable, a lock actuator connected to said locking means and to said deadbolt actuator means so as to activate or deactivate said locking means according to whether said deadbolt actuator means is operated to cause said deadbolt to move into its operative or inoperative position respectively, operating means connected to said lock actuator and being operative to render said locking means active and inactive independent of operation of said deadbolt actuator means, and clutch means forming part of the connection between said lock actuator and said locking means and being operative to allow said deadbolt actuator means to be operated to move the deadbolt towards its operative position when said locking means is active, wherein each said bolt is drivably connected to a respective said drive spindle, each said bolt actuator means includes an inner part and an outer part each of which is connected to a respective opposite end of the respective said drive spindle, and said control mechanism includes drive means between the two said actuator means, said drive means being operative to cause both said bolts to move into their inoperative positions when either said inner part is operated to move its respective bolt towards the inoperative position.

17. A lock set according to claim 16, wherein said latch bolt drive spindle is hollow, said lock actuator includes a locking spindle located within said latchbolt drive spindle and a gear wheel connected to said locking spindle, and said connection between the lock actuator and the deadbolt actuating means includes a pivotally mounted locking lever having a gear segment at one end which is movable into and out of engagement with said gear wheel as a consequence of pivotal movement of said locking lever.

18. A lock set according to claim 17, wherein said locking means operates to render only the outer part of said latchbolt actuator means inoperable, and said operating means is associated with said inner part of the latchbolt actuator means and is drivably connected to said locking, spindle

19. A lock set according to claim 17, wherein said latchbolt drive spindle includes two sections each of which is located on a respective opposite side of said gear wheel, and a drive connection is provided between said spindle sections external of said gear wheel.

20. A lock set according to claim 17, wherein said gear wheel is connected to said locking spindle through said clutch means, said gear wheel is rotatable relative to said locking spindle about the axis of that spindle, and said clutch means includes a member connected to said locking spindle for rotation therewith and cooperably engaging with said gear wheel to prevent rotation of said gear wheel relative to the locking spindle in one direction.

21. A lock set including control mechanism comprising a housing, latch bolt actuator means mounted on said housing and being movable relative thereto between latch operative and inoperative positions, deadbolt actuator means mounted on said housing and being movable relative thereto between deadbolt operative and inoperative positions, a lock actuator mounted on said housing and being operable to cause operation of locking means which renders the latch bolt actuator means inoperable, said lock actuator is connected to the deadbolt actuator means to activate or deactivate said locking means according to whether said deadbolt actuator means is moved into its deadbolt operative or inoperative position respectively, and drive means interconnecting the two said bolt actuator means so that each is responsive to operation of the other such that movement of either said bolt actuator means towards its respective bolt inoperative position causes corresponding movement of the other said bolt actuator means, a latch bolt movable relative to said housing between operative and inoperative positions, a deadbolt movable relative to said housing between operative and inoperative positions, separate drive spindles connecting each said bolt to its respective said actuator means, each said actuator means including an inner part and an outer part each of which is connected to a respective opposite end of the respective said drive spindle, said locking means is operative to render only the outer part of said latchbolt actuator means inoperable, and said drive means is such that said latchbolt does not move towards its inoperative position in response to operation of said outer part of the deadbolt actuator means to move the deadbolt towards its inoperative position.

* * * * *